US011732976B1

(12) United States Patent
Chen et al.

(10) Patent No.: US 11,732,976 B1
(45) Date of Patent: Aug. 22, 2023

(54) RAPID HEAT DISSIPATION DEVICE

(71) Applicant: AIC INC., Taoyuan (TW)

(72) Inventors: Yen-Chih Chen, Taoyuan (TW); Hsih-Ting You, Taoyuan (TW); Chi-Fu Chen, Taoyuan (TW); Wei-Ta Chen, Taoyuan (TW); Chien-Yang Lin, Taoyuan (TW)

(73) Assignee: AIC INC., Taoyuan (TW)

( * ) Notice: Subject to any disclaimer, the term of this patent is extended or adjusted under 35 U.S.C. 154(b) by 0 days.

(21) Appl. No.: 17/685,329

(22) Filed: Mar. 2, 2022

(51) Int. Cl.
*F28F 3/06* (2006.01)
*F28D 15/02* (2006.01)
*F28D 21/00* (2006.01)

(52) U.S. Cl.
CPC ..... *F28F 3/06* (2013.01); *F28D 15/025* (2013.01); *F28D 15/0266* (2013.01); *F28D 15/0275* (2013.01); *F28D 2021/0029* (2013.01)

(58) Field of Classification Search
CPC ..... F28F 3/06; F28D 15/025; F28D 15/0266; F28D 15/0275; F28D 15/04; F28D 2021/0029
USPC ..... 165/104.11, 104.33
See application file for complete search history.

(56) References Cited

U.S. PATENT DOCUMENTS 7,616,444 B2 * 11/2009 Munch ..... F28D 15/0275 165/80.4
10,591,964 B1 * 3/2020 Mikjaniec ..... H05K 7/208
11,408,684 B1 * 8/2022 Richard ..... F28D 15/0266
2007/0242438 A1 * 10/2007 Belits ..... H05K 7/20809 165/185
2014/0331709 A1 * 11/2014 Chiba ..... F28D 15/0266 165/59
2015/0085442 A1 * 3/2015 Kondo ..... H05K 7/20809 361/679.54
2015/0216079 A1 * 7/2015 Kondou ..... F28F 1/40 165/104.21
2015/0354901 A1 * 12/2015 Moore ..... F28D 15/04 165/104.21
2016/0018139 A1 * 1/2016 Olsson ..... F25B 21/02 62/3.3

(Continued)

FOREIGN PATENT DOCUMENTS

CN 210534701 U * 5/2020
CN 215731673 U * 2/2022
EP 3698611 B1 * 10/2022 ..... B60R 16/0231

*Primary Examiner* — Len Tran
*Assistant Examiner* — Gustavo A Hincapie Serna
(74) *Attorney, Agent, or Firm* — Chun-Ming Shih; HDLS IPR Services

(57) ABSTRACT

A rapid heat dissipation device is provided to use for a heat source, and includes a heat conducting plate, a heat dissipating fin group, one or a plurality of heat pipes and a siphon heat-dissipating device. The heat conducting plate is thermally attached to the heat source. The heat dissipating fin group is arranged on one side of the heat conducting plate. One end of the heat pipe is fixed to the heat conducting plate, and another end is fixed to the heat dissipating fin group. The siphon heat-dissipating device is stacked above the heat pipe, and one end is fixed to the heat-conducting plate and another end is fixed to the heat-dissipating fin group. Through the siphon heat-dissipating device overlapping up and down with the heat pipe and having the same direction to achieve uniformly heat dissipating and cooling.

6 Claims, 7 Drawing Sheets

(56) References Cited

U.S. PATENT DOCUMENTS

| | | | | |
|---|---|---|---|---|
| 2017/0020032 | A1* | 1/2017 | Wang | G06F 1/203 |
| 2017/0074596 | A1* | 3/2017 | Wang | G06F 1/203 |
| 2020/0217595 | A1* | 7/2020 | Wu | F28D 15/0266 |
| 2020/0267872 | A1* | 8/2020 | Harada | H05K 7/208 |
| 2020/0340754 | A1* | 10/2020 | Hanafusa | F28F 3/025 |
| 2021/0113938 | A1* | 4/2021 | Wan | F28D 1/0476 |
| 2021/0212238 | A1* | 7/2021 | Tian | H05K 7/20772 |
| 2021/0318072 | A1* | 10/2021 | Ito | F28D 15/02 |
| 2022/0004234 | A1* | 1/2022 | Zong | F28D 15/0275 |
| 2022/0174845 | A1* | 6/2022 | Chen | H05K 7/20809 |
| 2022/0295674 | A1* | 9/2022 | Wallner | H05K 7/20318 |
| 2022/0307772 | A1* | 9/2022 | Sasabe | F28D 15/0266 |
| 2022/0354019 | A1* | 11/2022 | Tsai | F28F 3/12 |
| 2022/0418154 | A1* | 12/2022 | Chen | H05K 7/20263 |

* cited by examiner

RAPID HEAT DISSIPATION DEVICE

BACKGROUND OF THE DISCLOSURE

Technical Field

The present disclosure relates to a heat dissipation device, particularly to a rapid heat dissipation device.

Description of Related Art

A related-art heat dissipation device is to utilize a heat conducting plate thermally attached to a heat source, and a plurality of fins are disposed on the heat conducting plate to form a heat radiator. Heat is transferred to the fins or the heat radiator through the heat conducting plate to provide a heat dissipating function to the heat source.

With the requirement of heat dissipating performance being higher, an additional device or method, for example disposing a fan or water cooling to provide an external heat-dissipating force, is used for providing an assisting heat dissipating capability under the structure of the related-art heat dissipation device. A heat pipe or a vapor chamber having a coolant or a working fluid being provided therein are also used for increasing the effects of heat dissipating or cooling.

However, the above-mentioned structure has disadvantages as follows. Situations of heat being gathered in the heat source or collected at a portion of the heat dissipation device during the heat transferring process may happen, thus the heat dissipation device may not fully perform the effects of heat dissipating or cooling when the heat dissipating device is not uniformly heated and unable to uniformly dissipate heat.

Accordingly, the applicant of the present disclosure has devoted himself for improving the mentioned disadvantages.

SUMMARY OF THE DISCLOSURE

The present disclosure is to provide a rapid heat dissipation device, in which heating flowing field of a siphon heat-dissipating device overlaps up and down with that of a heat pipe in the same direction, the rapid heat dissipation device has advantages of uniformly dissipating heat and cooling.

Accordingly, the present disclosure provides a rapid heat dissipation device, provided to use for a heat source, and includes: a heat conducting plate, thermally attached to the heat source; a heat dissipating fin group, arranged on one side of the heat conducting plate; at least one heat pipe, one end thereof fixed to the heat conducting plate and another end thereof fixed to the heat dissipating fin group; and a siphon heat-dissipating device, stacked above the at least one heat pipe and one end thereof fixed to the heat conducting plate and another end thereof fixed to the heat dissipation fin group.

Based on what has been disclosed above, the siphon heat-dissipating device is stacked above the heat pipe, one end of the heat pipe and one end of the siphon heat-dissipating device are fixed to the heat conducting plate and another end of the heat pipe and another end of the siphon heat-dissipating device are fixed to the heat dissipating fin group. As such, through heating flowing field of the siphon heat-dissipating device overlapping up and down with that of the heat pipe in the same direction, situations of heat being gathered in the heat source or collected at a portion of the heat dissipation device during the heat transferring process may be avoided, thus the rapid heat dissipation device has advantages of uniformly dissipating heat and cooling.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION OF THE EMBODIMENTS

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
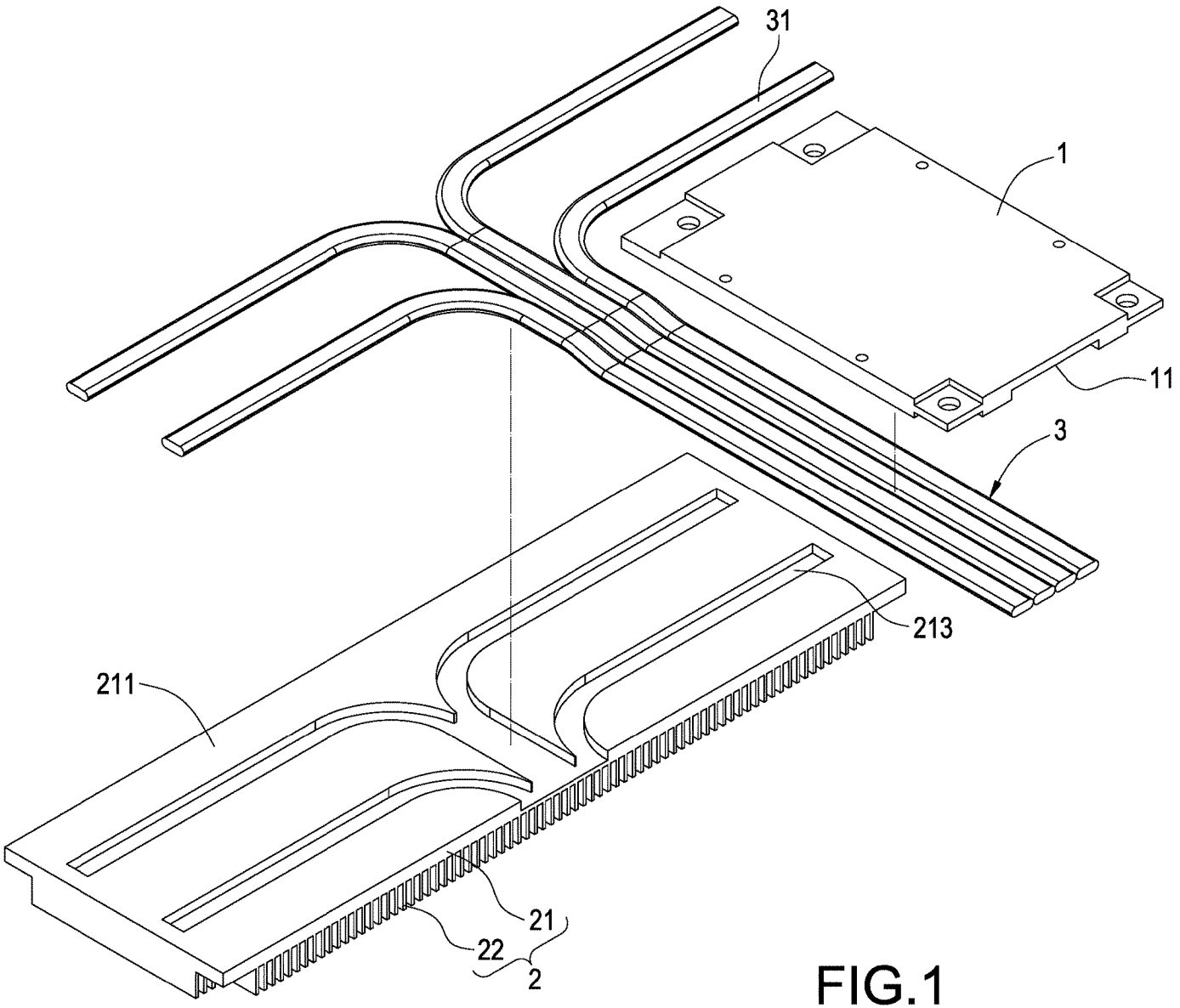
FIG. 1 is a perspective exploded view showing a rapid heat dissipation device according to the present disclosure.
Figure 2:
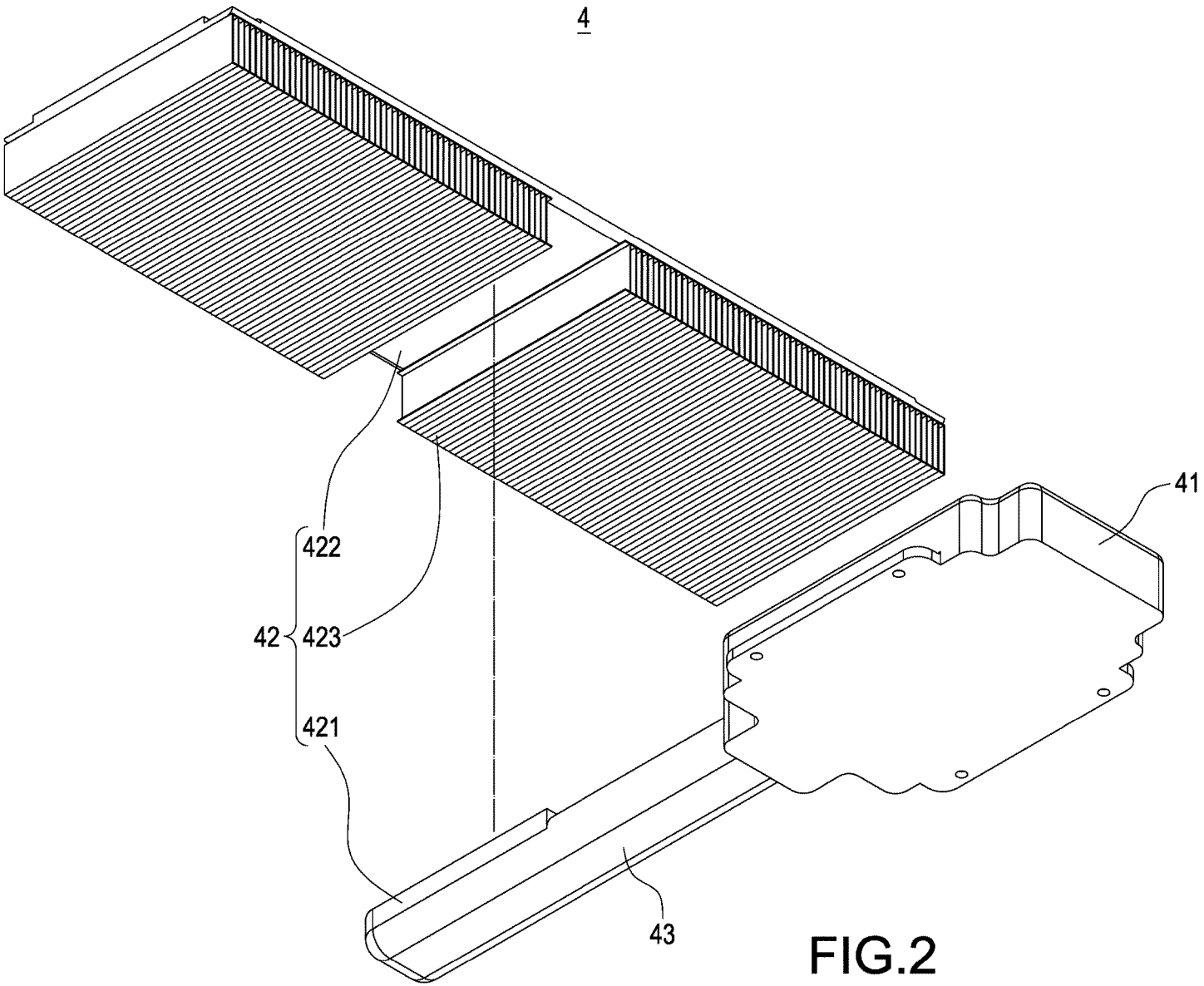
FIG. 2 is another perspective exploded view showing the rapid heat dissipation device according to the present disclosure.
Figure 3:
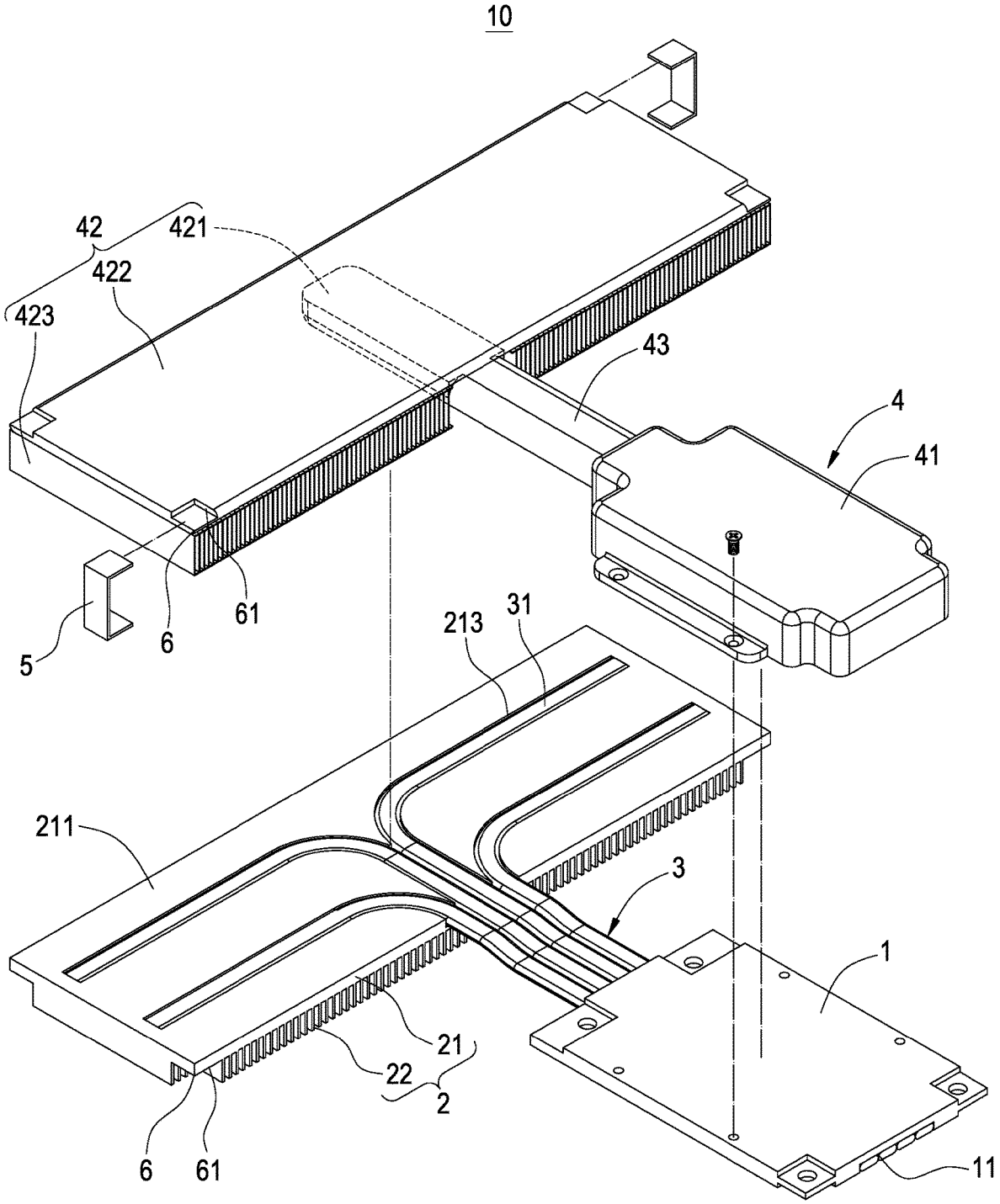
FIG. 3 is another perspective exploded view showing the rapid heat dissipation device according to the present disclosure.
Figure 4:
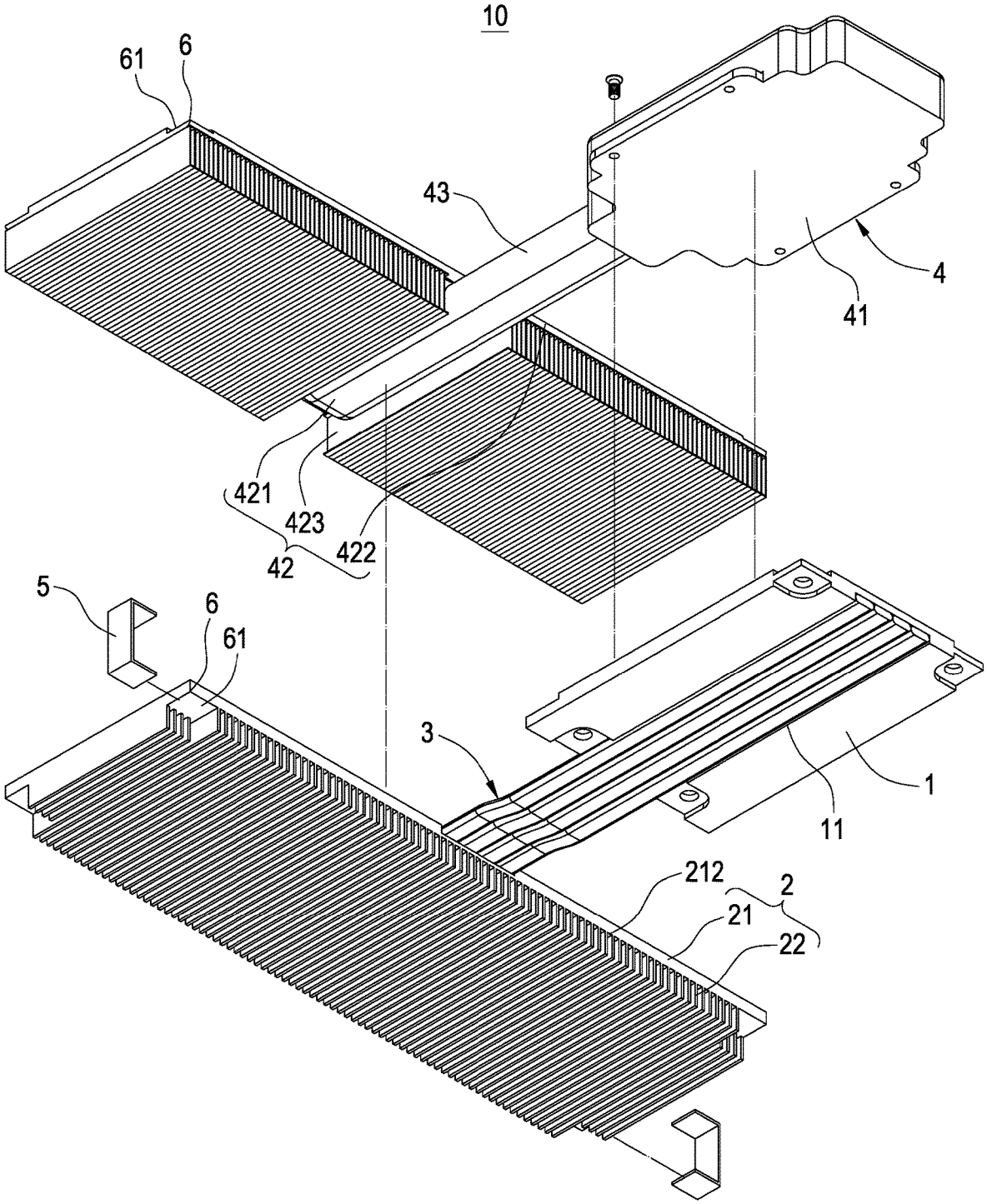
FIG. 4 is one another perspective exploded view showing the rapid heat dissipation device according to the present disclosure.
Figure 5:
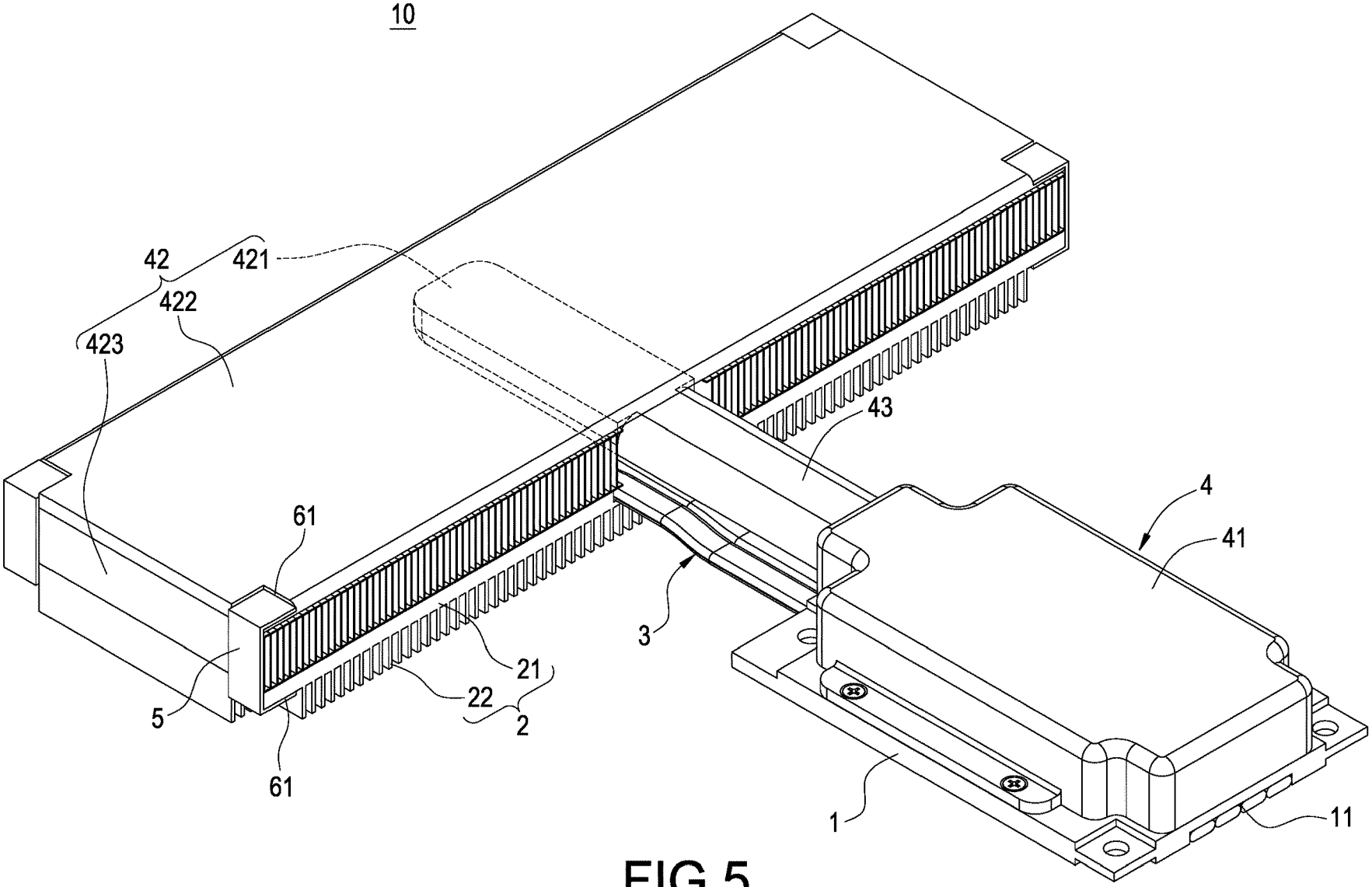
FIG. 5 is a perspective view showing the assembly of the rapid heat dissipation device according to the present disclosure.
Figure 6:
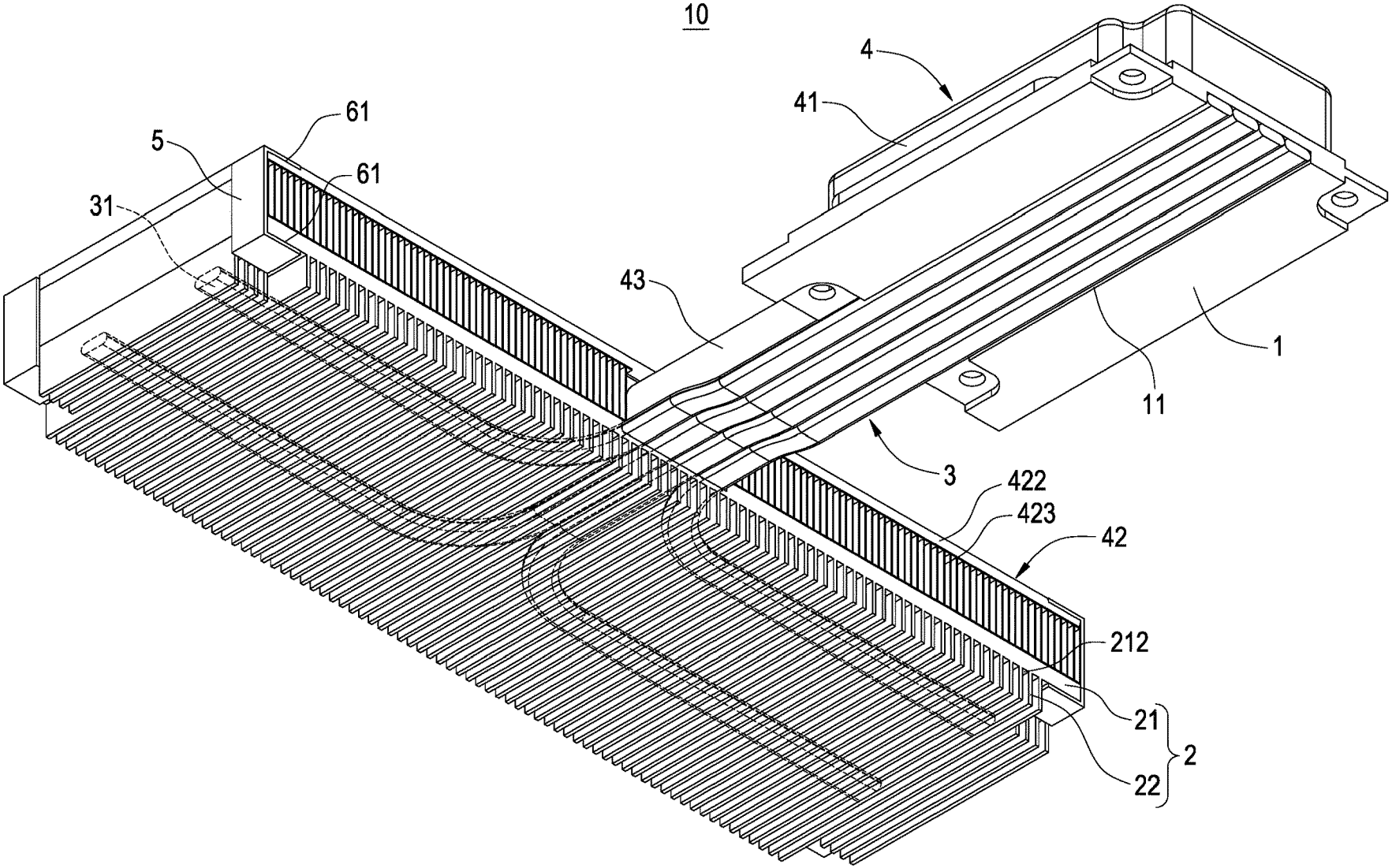
FIG. 6 is a another perspective view showing the assembly of the rapid heat dissipation device according to the present disclosure.
Figure 7:
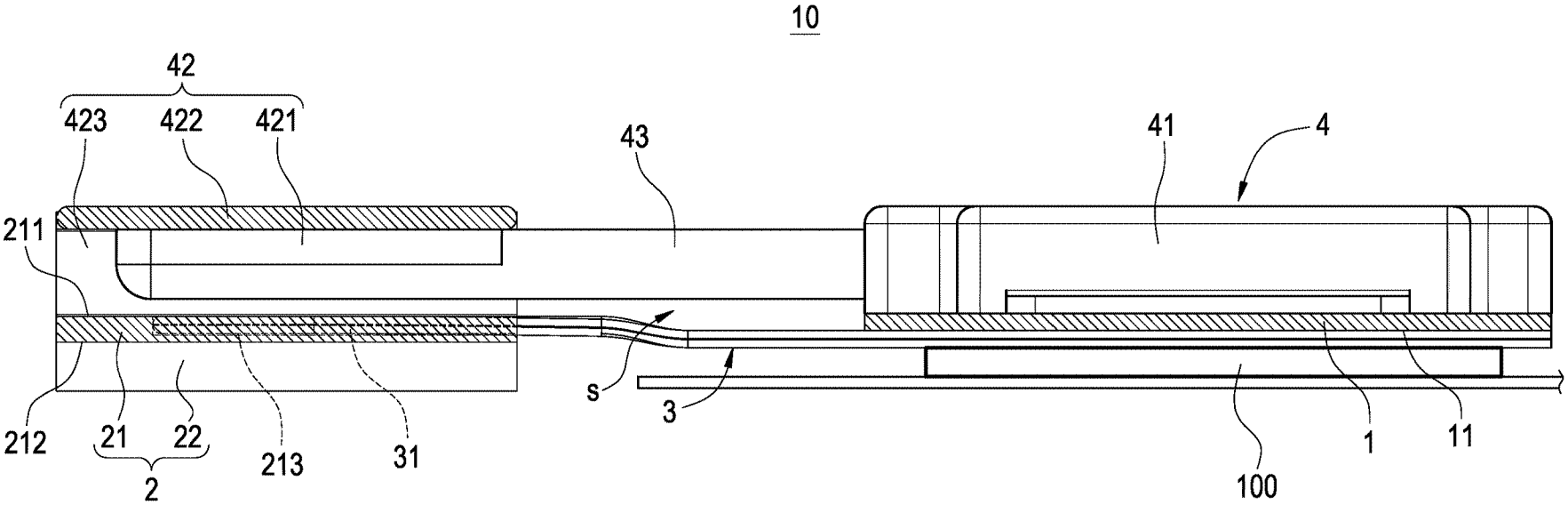
FIG. 7 is a cross sectional view showing the assembly of the rapid heat dissipation device according to the present disclosure.

Please refer from FIG. 1 to FIG. 7, the preset disclosure discloses a rapid heat dissipation device 10 provided to use for a heat source 100. The rapid heat dissipation device 10 includes a heat conducting plate 1, a heat dissipating fin group 2, one or a plurality of heat pipes 3 and a siphon heat-dissipating device 4.

Please refer to FIG. 1, FIG. 3, FIG. 4, FIG. 5, FIG. 6, and FIG. 7, the heat conducting plate 1 is made of a heat conducting material. The heat conducting plate 1 is thermally attached to the heat source 100. That heat conducting plate 1 has an I-shaped mounting slot 11.

In some embodiments, the heat conducting plate 1 is thermally attached above the heat source 100. The I-shaped mounting slot 11 is formed at a bottom end of the heat conducting plate 1, but here is not intended to be limiting. The heat source 100 may be disposed in the heat conducting plate 1, and the I-shaped mounting slot 11 may be formed at a top end of the heat conducting plate 1 or penetrate the heat conducting plate 1.

Please refer to FIG. 1, FIG. 3, FIG. 4, FIG. 5, FIG. 6 and FIG. 7, the heat dissipating fin group 2 is arranged on one side of the heat conducting plate 1. The heat dissipating fin group 2 has a substrate 21 and a plurality of first fins 22 connected to the substrate 21 with a squeezing, milling, or welding manner. The substrate 21 and the first fin 22 are made of a heat conducting metal, for example aluminum or copper.

The substrate 21 has a top surface 211 and a bottom surface 212. In some embodiments, the top surface 211 of the substrate 21 has a plurality of L-shaped mounting slots 213 extended from the center toward two sides. The plurality of first fins 22 are connected to the bottom surface 212 of the substrate 21, but here is not intended to be limiting.

Please refer to FIG. 1, FIG. 3, FIG. 4, FIG. 5, FIG. 6, and FIG. 7, one end (first end) of the heat pipe 3 is fixed to the heat conducting plate 1 and another end (second end) is fixed to the heat dissipating fin group 2. In some embodiments, there are a plurality of heat pipes 3, the ends (first ends) of the heat pipes 3 are mutually aligned to be mounted in the I-shaped mounting slot 11, and an L-shaped bending segment 31 is extended from another end of each of the heat pipes 3 and mounted in each of the L-shaped mounting slots 213, thus heat is transferred from the center of the substrate 21 toward two sides of the substrate 21 through the plurality of L-shaped bending segments 31.

Please refer from FIG. 2 to FIG. 7, the siphon heat-dissipating device 4 is stacked above the heat pipe 3. One end of the siphon heat-dissipating device 4 is fixed to the heat conducting pipe 1 and another end is fixed to the heat dissipating fin group 2.

Details are provided as follows. The siphon heat-dissipating device 4 has an evaporator 41, a condenser 42, a convey pipe 43 and a working fluid. The evaporator 41 is stacked above and fixed to the heat conducting plate 1. The condenser 42 is stacked above and fixed to the heat dissipating fin group 2. The convey pipe 43 is stacked above the heat pipe 3 and two ends thereof communicate with the evaporator 41 and the condenser 42.

In some embodiments, the evaporator 41 is a hollow case body made of a heat conducting material. The convey pipe 43 is a hollow pipe member made of a heat conducting material. The working fluid is filled in the evaporator 41, the condenser 42 and the convey pipe 43. The evaporator 41 is fixed above the heat conducting plate 1 with a locking or welding manner.

The condenser 42 has an extending pipe 421 extended from one end of the convey pipe 43 away from the evaporator 41, a heat dissipating plate 422 fixed above the extending pipe 421 and a plurality of second fins 423 connected to the heat dissipating plate 422. The plurality of second fins 423 are disposed between the heat dissipating plate 422 and the heat dissipating fin group 2 and arranged on two sides of the extending pipe 421. A distance s is formed between the convey pipe 43 and the heat pipe 3.

In some embodiments, the plurality of second fins 423 are connected to the heat dissipating plate 422 with a squeezing, milling, or welding manner, and disposed between the heat dissipating plate 422 and the top surface 211 of the substrate 21. The extending pipe 421 and the heat dissipating plate 422 are combined with a welding manner, but here is not intended to be limiting.

Please refer from FIG. 3 to FIG. 6, the rapid heat dissipation device of the present disclosure further includes a plurality of C-shaped clips 5. The plurality of C-shaped clips 5 are disposed to clip outer sides of the substrate 21 and the heat dissipating plate 422.

In some embodiments, a plurality of corners 6 are respectively formed on the substrate 21 and the heat dissipating plate 422, and a plurality of recessed slots 61 are concavely formed on the plurality of corners 6. Two ends of each of the C-shaped clips 5 clip the two recessed slots 61 correspondingly arranged up and down, thus the substrate 21 and the heat dissipating plate 422 are stably stacked up and down.

Please refer from FIG. 3 to FIG. 7, when the rapid heat dissipation device 10 of the present disclosure is in an operating status, the siphon heat-dissipating device 4 is stacked above the heat pipe 3, one end of the heat pipe 3 and one end of the siphon heat-dissipating device 4 are fixed to the heat conducting plate 1 and another end of the heat pipe 3 and another end of the siphon heat-dissipating device 4 are fixed to the heat dissipating fin group 2. As such, through heating flowing field of the siphon heat-dissipating device 4 overlapping up and down with that of the heat pipe 1 in the same direction to achieve uniformly heat dissipating and cooling, situations of heat being gathered in the heat source or collected at a portion of the heat dissipation device during the heat transferring process may be avoided, thus the rapid heat dissipation device 10 has advantages of uniformly dissipating heat and cooling.

Moreover, the plurality of C-shaped clips 5 are disposed to clip the outer sides of the substrate 21 and the heat dissipating plate 422, thus the heat dissipating fin group 2 and the condenser 42 are stably stacked up and down to increase the structural strength of the rapid heat dissipation device 10.

While this disclosure has been described by means of specific embodiments, numerous modifications and variations could be made thereto by those skilled in the art without departing from the scope and spirit of this disclosure set forth in the claims.

What is claimed is:

1. A heat dissipation device, used for a heat source, the heat dissipation device comprising:

a heat conducting plate, thermally attached to the heat source;

a heat dissipating fin group, arranged on one side of the heat conducting plate, the heat dissipating fin group comprises a substrate and a plurality of first fins connected to the substrate;

at least one heat pipe, one end thereof fixed to the heat conducting plate and another end thereof fixed to the heat dissipating fin group;

a siphon heat-dissipating device, stacked above the at least one heat pipe and one end thereof fixed to the heat conducting plate and another end thereof fixed to the heat dissipation fin group, the siphon heat-dissipating device comprises an evaporator, a condenser, a convey pipe and a working fluid, the evaporator is stacked above and fixed to the heat conducting plate, the condenser is stacked above and fixed to the heat dissipating fin group, the convey pipe is stacked above the at least one heat pipe and two ends thereof communicate with the evaporator and the condenser, and the working fluid is filled in the evaporator, the condenser and the convey pipe, the condenser comprises an extending pipe extended from one end of the convey pipe away from the evaporator, a heat dissipating plate fixed above the extending pipe and a plurality of second fins connected to the heat dissipating plate, the plurality of second fins is disposed between the heat dissipating plate and the heat dissipating fin group and arranged on two sides of the extending pipe; and a plurality of C-shaped clips, is disposed to clip outer sides of the substrate and the heat dissipating plate.

2. The heat dissipation device according to claim 1, wherein the substrate and the heat dissipating plate respectively comprise a plurality of corners and a plurality of recessed slots concavely disposed on the plurality of corners, and two ends of each of the C-shaped clips clip two recessed slots correspondingly arranged up and down.

3. The heat dissipation device according to claim 1, wherein the substrate comprises a top surface and a bottom surface, the plurality of first fins is connected to the bottom surface, the plurality of second fins is connected to the heat dissipating plate and disposed between the heat dissipating plate and the top surface.

4. The heat dissipation device according to claim 3, wherein the heat pipe is multiple in number, the heat conducting plate comprises an I-shaped mounting slot, the substrate comprises a plurality of L-shaped mounting slots extended from a center toward two sides, one ends of the heat pipes are mutually aligned and mounted in the I-shaped mounting slot, and an L-shaped bending segment is extended from another end of each of the heat pipes and mounted in each of the L-shaped mounting slots.

5. The heat dissipation device according to claim 4, wherein the plurality of L-shaped mounting slots is disposed on the top surface of the substrate, and the I-shaped mounting slot is disposed on a bottom end of the heat conducting plate.

6. The heat dissipation device according to claim 1, wherein the convey pipe and the at least one heat pipe are separated by a distance.

* * * * *